US010233649B1

(12) United States Patent
Inzeo

(10) Patent No.: US 10,233,649 B1
(45) Date of Patent: Mar. 19, 2019

(54) ROOF EDGE BRACKET WITH EXTENDER PLATE FOR EXTENDED INSULATION

(71) Applicant: Metal-Era, Inc., Waukesha, WI (US)

(72) Inventor: Joseph A. Inzeo, West Allis, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 16/160,195

(22) Filed: Oct. 15, 2018

Related U.S. Application Data

(63) Continuation-in-part of application No. 16/102,873, filed on Aug. 14, 2018, which is a continuation-in-part of application No. 15/396,836, filed on Jan. 3, 2017, now Pat. No. 9,874,023.

(51) Int. Cl.
*E04D 13/15* (2006.01)

(52) U.S. Cl.
CPC ..... *E04D 13/15* (2013.01)

(58) Field of Classification Search
CPC ..... E04D 13/15; E04D 2013/0468; E04D 13/0459
See application file for complete search history.

(56) References Cited

U.S. PATENT DOCUMENTS 3,404,495 A * 10/1968 Simpson, Jr. ..... E04D 13/15 52/273
4,780,997 A * 11/1988 Taylor ..... E04D 13/15 52/96
5,031,367 A * 7/1991 Butzen ..... E04D 13/155 52/300
5,251,411 A * 10/1993 Kelley ..... E04D 13/064 156/290
5,414,965 A * 5/1995 Kelley ..... E04D 13/064 52/60
5,619,827 A * 4/1997 Church ..... E04D 13/155 52/60
5,927,023 A * 7/1999 Kittilstad ..... E04D 13/155 52/60
6,088,967 A * 7/2000 Johnson ..... F21V 3/00 362/145
6,606,828 B1 * 8/2003 Lin ..... E04D 3/405 52/300
6,725,617 B2 * 4/2004 Cox ..... E04B 5/10 52/302.6

(Continued)

*Primary Examiner* — Andrew J Triggs
(74) *Attorney, Agent, or Firm* — Donald J. Ersler

(57) ABSTRACT

A roof edge mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. The roof edge bracket has a plurality of variations. A roof edge bracket extender preferably includes a modified roof edge bracket and an extender plate. The modified roof edge bracket includes a roof edge bracket and an extender projection. A second embodiment of a roof edge bracket extender preferably includes a second modified roof edge bracket and a second extender plate. A third embodiment of a roof edge bracket extender preferably includes a third modified roof edge bracket and at least one third extender plate.

3 Claims, 12 Drawing Sheets

(56) References Cited

U.S. PATENT DOCUMENTS

| | | | | |
|---|---|---|---|---|
| 6,845,590 | B1 * | 1/2005 | Mills, Jr. | E04D 13/155 52/60 |
| 6,912,814 | B1 * | 7/2005 | Inzeo | E04D 3/405 52/300 |
| 7,451,572 | B1 * | 11/2008 | Inzeo | E04D 3/405 52/300 |
| 7,610,729 | B1 * | 11/2009 | Ayers, Jr. | E04D 13/152 454/260 |
| 7,735,267 | B1 * | 6/2010 | Ayers, Jr. | E04D 13/155 52/302.6 |
| 7,748,173 | B1 * | 7/2010 | Inzeo | E04D 3/405 52/300 |
| 8,024,894 | B1 * | 9/2011 | Ayers, Jr. | E04D 13/155 52/302.6 |
| 9,874,023 | B1 * | 1/2018 | Inzeo | E04D 13/15 |
| 2006/0080900 | A1 * | 4/2006 | Graham | E04D 13/0459 52/24 |
| 2007/0266657 | A1 * | 11/2007 | Gembala | E04D 13/15 52/288.1 |

* cited by examiner

ROOF EDGE BRACKET WITH EXTENDER PLATE FOR EXTENDED INSULATION

CROSS-REFERENCES TO RELATED APPLICATIONS

This continuation in part patent application claims the benefit of patent Ser. No. 16/102,873, filed on Aug. 14, 2018, which claims the benefit of patent application Ser. No. 15/846,329, filed on Dec. 19, 2017, which claims the benefit of patent application Ser. No. 15/396,836, filed on Jan. 3, 2017.

BACKGROUND OF THE INVENTION

Field of the Invention

The present invention relates generally to building trim and more specifically to a roof edge bracket with extender plate for extended insulation, which may be used when installing roof edge trim to a building and extending insulation over a constructed wall of the building.

Discussion of the Prior Art

Roof trim is typically mounted to a wood nailer, which is found on a top of a building. Roof trim includes fascias, drip edges, gutters, copings and the like. Sometimes the wood nailer may rot and not be suitable for attachment of the roof trim. Lately, building designers have been using non-wood nailers and multiple layers of insulation. An attachment height of the roof trim to the wood or non-wood nailer would be too low relative to a top of a building with multiple layers of insulation. The multiple layers of added insulation could be as much as 6-8 inches thick or greater. A device is needed to extend upward the attachment point of the roof trim. U.S. Pat. No. 7,451,572 to Inzeo et al. discloses a roof fascia with extension cleat. Typically, a wood nailer is attached to a top of a pre-cast concrete wall. Roof trim is then attached to a side of wood nailer with fasteners. It has been found that extending insulation over a top of a pre-cast concrete wall increases insulation efficiency. However, a lower portion of roof trim cannot be reasonably secured to a wood nailer.

Accordingly, there is a clearly felt need in the art for a roof edge bracket with extender plate for extended insulation, which may be used when insulation is extended over a top of a pre-cast concrete wall, a concrete block wall, a plurality of insulation filled metal studs, or any other suitable roof/wall combination.

SUMMARY OF THE INVENTION

The present invention provides a roof edge mounting bracket for extended insulation, which may be used when insulation is extended over a top of a pre-cast concrete wall. A roof edge includes fascias, drip edges, gutters, copings and the like. A roof edge mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. It is preferable that a height of the upper portion is about at least 0.5 inches and the lower portion about 0.5 inches. If multiple layers of insulation are used, the upper portion of the vertical attachment flange will have to be greater than the 0.5 inches. The insulation may be replaced with cover board, or used in conjunction with cover board. The lower portion of the vertical attachment flange may be equal in length, less in length or greater in length than the upper portion of the vertical attachment flange. An angled roof edge bracket includes a base member and a vertical attachment flange. The base member extends from the vertical attachment flange at an acute angle.

A cantilevered roof edge bracket preferably includes a cantilevered base member and a vertical attachment flange. The vertical attachment flange does not make contact with an outer surface of a wall. A portion of the cantilevered base member does not make contact with the wall to provide clearance for a non-supporting decorative panel applied to the outer surface of the wall. Insulation is extended outward to an upper portion of the vertical attachment flange. A fascia bracket is attached to the vertical attachment flange (not shown).

A plurality of staggered fastener openings are formed through the base member. The roof edge mounting bracket is preferably fabricated from an aluminum extrusion, but other materials and manufacturing processes may also be used. The base member is inserted between a top of a nailer and a bottom of an insulation board. The wood nailer is mounted to a top of a corrugated metal deck. The roof edge mounting bracket is secured to a building with a plurality of fasteners inserted through the plurality of fastener openings and the plurality of fasteners screwed into the nailer. However, if the wood nailer is damaged, longer fasteners must be used, which will be screwed into the corrugated metal deck. The roof trim is attached to the top portion of the vertical attachment flange with a plurality of self-tapping fasteners.

A wood nailer is attached to a top of a pre-cast concrete wall. The base member of the roof edge mounting bracket is secured to the top of the wood nailer with a plurality of fasteners. At least one layer of insulation is placed over the existing roof insulation, the wood nailer and the base member. A roof trim may be secured to the upper portion of the vertical attachment flange of the roof edge mounting bracket with a plurality of trim fasteners.

The base member of the roof edge mounting bracket may be secured directly to a top of a pre-cast concrete wall with a plurality of fasteners. At least one layer of insulation is placed over the existing roof insulation, the pre-cast concrete wall and the base member. Roof trim may be secured to the upper portion of the vertical attachment flange of the roof edge mounting bracket with a plurality of trim fasteners.

The base member of the roof edge mounting bracket may be secured directly to a top of a corrugated metal deck with a plurality of fasteners. The corrugated metal deck is attached to a concrete insert in a top of a concrete block with a second plurality of fasteners. At least one layer of insulation is placed over the corrugated metal deck. Roof trim may be secured to the upper portion of the vertical attachment flange of the roof edge mounting bracket with a plurality of trim fasteners.

The base member of the roof edge mounting bracket may be secured to a cap channel, which terminates a top of a plurality of insulation filled metal studs with a plurality of fasteners. At least one layer of insulation is placed over existing roof insulation, the cap channel and the base member. The roof trim may be secured to the upper portion of the vertical attachment flange of the roof edge mounting bracket with a plurality of trim fasteners.

A roof edge angle bracket includes a base member and a vertical attachment flange. The vertical attachment flange extends upward from an end of the base member. The vertical attachment flange does not include a lower portion.

A roof edge vertical bracket preferably includes a vertical attachment flange, a bottom offset lip and an upper retaining lip. The bottom offset lip extends from a bottom of the vertical attachment flange. The upper retaining lip extends upward from a top of the vertical attachment flange. The upper retaining lip includes a turned over lip and a clip extension. The clip extension extends from a top of the turned over lip.

A roof edge bracket extender preferably includes a modified roof edge bracket and an extender plate. The modified roof edge bracket includes a roof edge bracket and an extender projection. The roof edge bracket includes a base member and a vertical attachment flange. The base member extends inward from the vertical attachment flange. The extender projection is formed parallel to the vertical attachment flange. The extender projection extends upward from a top of the base member. A lengthwise notch is formed on an inner surface of the extender projection. The extender plate includes an outer leg and an inner leg extending from on a bottom thereof. A flange pocket is formed between the inner and outer legs. The flange pocket is sized to receive the vertical attachment flange. A leg pocket is formed between the extender projection and the vertical attachment flange to receive the inner leg. A snap projection extends from an outer surface of the inner leg. The lengthwise notch is sized to receive the snap projection. The vertical attachment flange is inserted into the flange pocket and the inner leg is inserted into the leg pocket and retained in place when the snap projection engages the lengthwise notch.

A second embodiment of a roof edge bracket extender preferably includes a second modified roof edge bracket and a second extender plate. The second modified roof edge bracket includes a base member and a vertical attachment flange. The base member extends inward from the vertical attachment flange. An interference slot is formed in a top edge of the vertical attachment flange, along a length of the vertical attachment flange. The interference slot includes a pair of opposing side walls and a retention cavity. The retention cavity is wider than a distance between the pair of opposing side walls. The second extender plate includes a lengthwise snap projection extending from a bottom thereof. The lengthwise snap projection includes a snap portion and a relieved portion. The relieved portion extends from a bottom of the second extender plate. The snap portion extends from a bottom of the relieved portion. The snap portion is wider than a distance between the pair of opposing side walls. A width of the retention cavity is sized to receive a width of the snap portion.

A third embodiment of a roof edge bracket extender preferably includes a third modified roof edge bracket and at least one third extender plate. The third modified roof edge bracket includes a base member and a vertical attachment flange. The base member extends inward from the vertical attachment flange. A pair of opposing snap slots are formed in a top of the vertical attachment flange, along a length of the vertical attachment flange. The third extender plate includes an attachment yoke. The attachment yoke extends from a bottom of the third extender plate. The attachment yoke includes a retention slot and a pair of opposing snap projections. The retention slot is sized to receive a thickness of the vertical attachment flange. The pair of opposing snap projections extend from opposing side walls of the retention slot. The opposing snap projections are sized to be received by the pair of opposing snap slots formed in the vertical attachment flange. A pair of opposing extender snap slots may be formed in a top of the third extender plate to receive an attachment yoke of an additional extender plate.

Accordingly, it is an object of the present invention to provide a roof edge mounting bracket, which may be used with a damaged wood nailer to mount roof trim on a building.

It is a further object of the present invention to provide a roof edge mounting bracket, which may be used to extend upward an attachment height of the roof trim.

It is another object of the present invention to provide a roof edge mounting bracket for extended insulation, which may be used when insulation is extended over a top of a pre-cast concrete wall, a concrete block wall, a plurality of insulation filed metal studs or the like.

It is yet another object of the present invention to provide an angled roof edge bracket, which may be attached to a wall.

It is yet another object of the present invention to provide a cantilevered angled roof edge bracket, which is attached to a top of a vertical wall.

It is yet another object of the present invention to provide a roof edge angle bracket, which is attached to a top of a vertical wall.

It is yet another object of the present invention to provide a roof edge vertical bracket, which is attached to an outer surface of a vertical wall.

Finally, it is another object of the present invention to provide a roof edge bracket extender, which includes a modified roof edge bracket and an extender plate.

These and additional objects, advantages, features and benefits of the present invention will become apparent from the following specification.

DETAILED DESCRIPTION OF THE PREFERRED EMBODIMENTS

Figure 1:
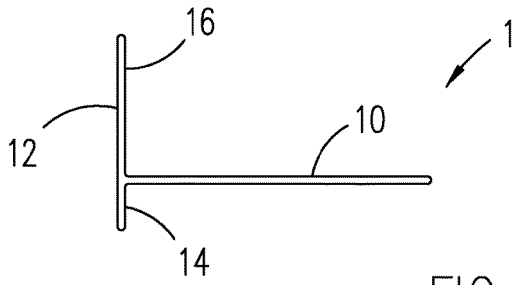
FIG. 1 is an end view of a roof edge mounting bracket in accordance with the present invention.
Figure 2:
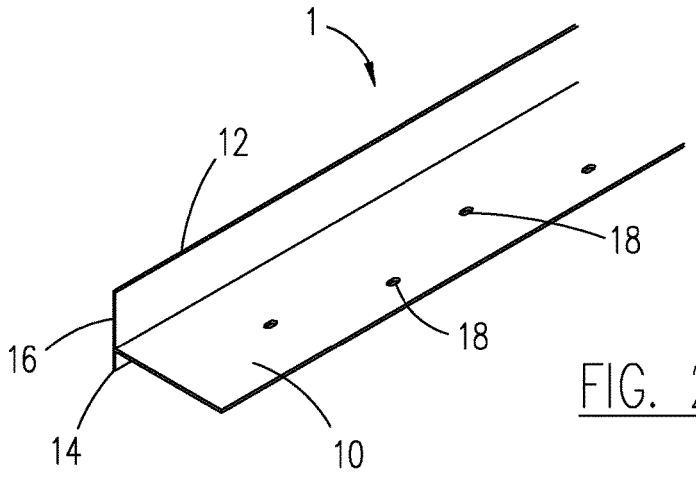
FIG. 2 is a perspective view of a roof edge mounting bracket in accordance with the present invention.
Figure 1A:
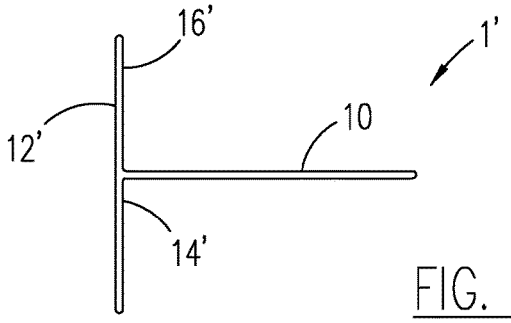
FIG. 1*a* is an end view of a roof edge mounting bracket with a lower portion of a vertical attachment flange, which is equal in length to an upper portion of a vertical attachment flange in accordance with the present invention.
Figure 3:
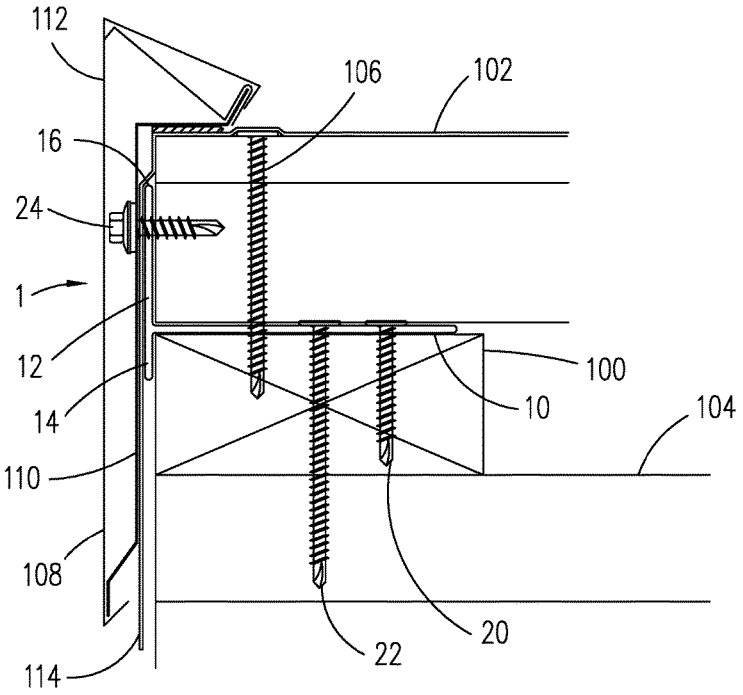
FIG. 3 is a cross sectional view of a roof edge mounting bracket attached to either a wood nailer or a corrugated metal deck, and fascia trim attached to the roof edge mounting bracket in accordance with the present invention.

With reference now to the drawings, and particularly to FIG. 2, there is shown a perspective view of a roof edge mounting bracket 1. With reference to FIGS. 1 and 3, the roof edge mounting bracket 1 preferably includes a base member 10 and a vertical attachment flange 12. The base member 10 extends outward in a horizontal orientation from the vertical attachment flange 12. A lower portion 14 of the vertical attachment flange 12 extends below the base member 10 and an upper portion 16 of the vertical attachment flange 12 extends above the base member 10. It is preferable that a height of the upper portion 16 is about at least 0.5 inches and the lower portion 14 is about 0.5 inches. If multiple layers of insulation are used, the upper portion 16 of the vertical attachment flange 12 will have to be greater than 0.5 inches. With reference to FIG. 1*a*, the lower portion 14' of the vertical attachment flange 12' may be equal in length, less in length or greater in length than the upper portion 16' of the vertical attachment flange 12' of a roof edge mounting bracket 1'.

Figure 1B:
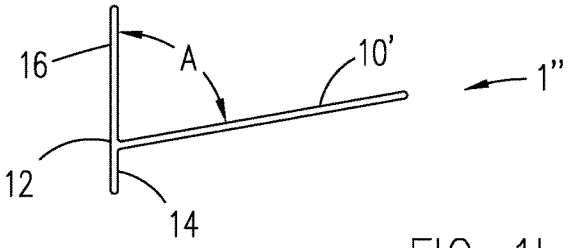
FIG. 1*b* is an end view of an angled roof edge bracket with a base member pointing upward in accordance with the present invention.
Figure 1C:
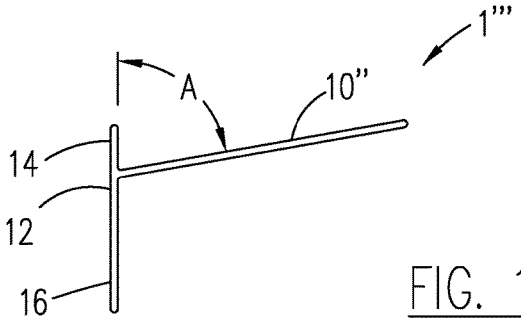
FIG. 1*c* is an end view of an angled roof edge bracket with a base member pointing downward in accordance with the present invention.
Figure 1D:
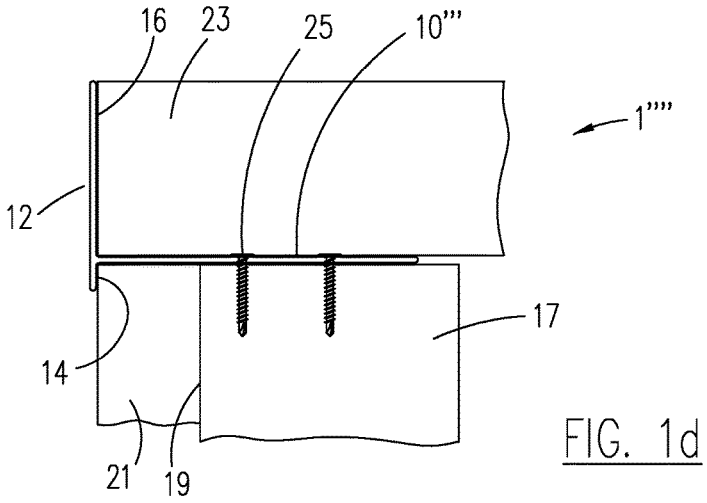
FIG. 1*d* is an end view of a cantilevered roof edge bracket, which provides clearance for a nonsupporting decorative panel in accordance with the present invention.

With reference to FIG. 1*b*, an angled roof edge bracket 1" includes a base member 10' and a vertical attachment flange 12. The base member 10' extends upward from the vertical attachment flange 12 at an acute angle A. With reference to FIG. 1*c*, an angled roof edge bracket 1'" includes a base member 10" and a vertical attachment flange 12. The base member 10" extends downward from the vertical attachment flange 12 at an acute angle A. With reference to FIG. 1*d*, a cantilevered roof edge bracket 1"" includes a cantilevered base member 10'" and the attachment flange 12. The vertical attachment flange 12 does not make contact with an outer surface 19 of a wall 17. The cantilevered base member 10'" does not make contact with the wall 17 to provide clearance for a non-supporting decorative panel 21 applied to the outer surface 19 of the wall 17. Insulation 23 is extended outward to the upper portion 16 of the vertical attachment flange 12. The cantilevered roof edge bracket 1"" is attached to a top of the wall 17 with a plurality of fasteners 25. A fascia bracket (not shown) is attachable to the vertical attachment flange 12. The insulation 23 may be replaced with cover board, or used in conjunction with cover board.

Figure 1E:
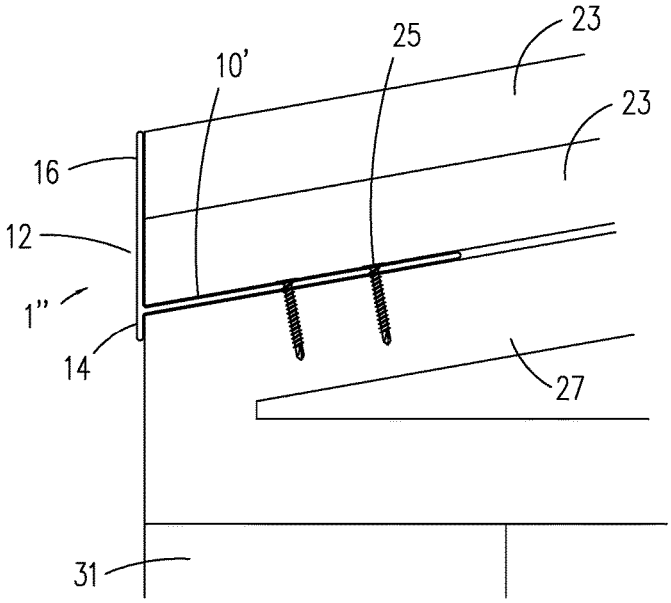
FIG. 1*e* is an end view of an angled roof edge bracket with a base member pointing upward attached to a sloped substrate of a building with a sloped roof in accordance with the present invention.

With reference to FIG. 1*e*, the angled roof edge bracket 1" is attached to a top of a sloped substrate 27 of a building with a sloped roof with the plurality of fasteners 25. At least one layer of insulation 23 is retained on the base member 10' and by the vertical attachment flange 12. The at least one layer of insulation 23 continues to an outer surface of a wall 31.

A plurality of staggered fastener openings 18 are preferably formed through the base member 10. The purpose of the staggered holes is to enable contractors to easily conform to insurance specifications. The roof edge mounting bracket 1 is preferably fabricated from an aluminum extrusion, but other materials and manufacturing processes may also be used. The base member 10 is inserted between a top of a wood nailer 100 and a bottom of an insulation board 102. The wood nailer 100 is mounted to a top of a corrugated metal deck 104. The roof edge mounting bracket 1 is secured to a building with a plurality of fasteners 20 inserted through the plurality of fastener openings 18 and fastened into the wood nailer 100 or a non-wood nailer. The plurality of fastener openings are preferably slots but could be any suitable shape. However, if the wood nailer 100 is damaged, longer fasteners 22 must be used, which will be fastened into the corrugated metal deck 104. The insulation board 102 is attached to the wood nailer with a plurality of fasteners 106. Fascia trim 108 includes a base portion 110 and a cover portion 112. The base portion 110 is attached to the top portion 16 of the vertical attachment flange 12 with a plurality of self-tapping fasteners 24. However, other designs of roof trim may also be used. A roof membrane 114 is laid over the insulation board 102 and located between the base portion 110 of the fascia trim 108 and the lower portion 14 of the vertical attachment flange 12.

Figure 4:
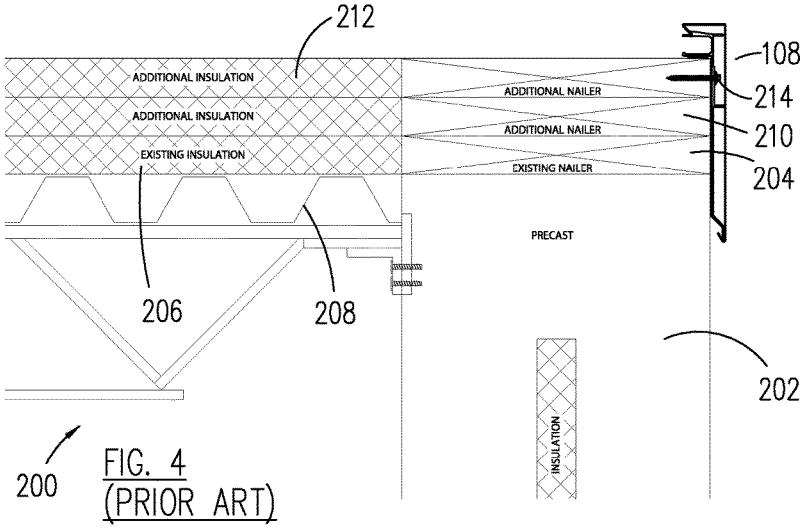
FIG. 4 (PRIOR ART)
FIG. 4 is a cross sectional view of a building with an existing wood nailer, two additional wood nailers, an existing insulation layer and two additional insulation layers with a fascia attached to a top one of the two additional wood nailers.

With reference to FIG. 4, in a prior art configuration, an existing wood nailer 204 is attached to a top of a pre-cast wall 202. An existing insulation layer 206 is placed over a roof 208 of a building 200, adjacent the existing wood nailer 204. Two additional wood nailers 210 are attached on top of the existing wood nailer 204 and two additional insulation layers 212 are attached to a top of the existing insulation layer 206. The fascia trim 108 is attached to a top one of the two additional wood nailers with fasteners 214.

Figure 5:
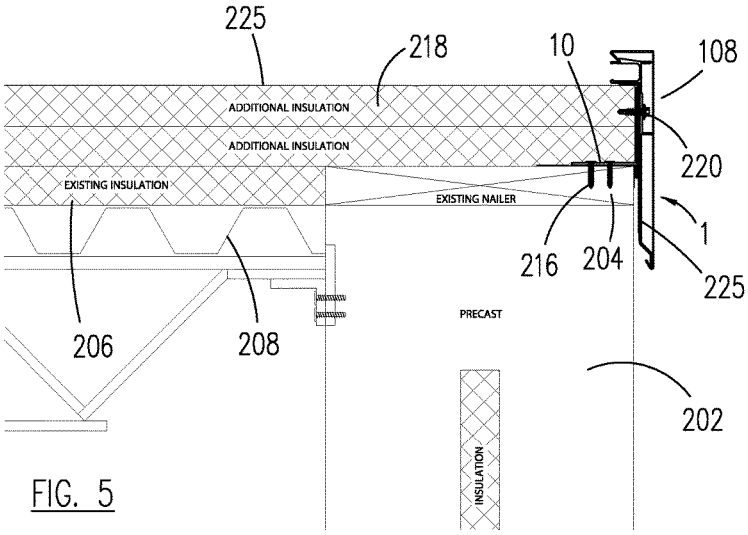
FIG. 5 is a cross sectional view of a building with an existing wood nailer, existing insulation layer and two extended, additional insulation layers with a fascia attached to a top of the existing wood nailer.

With reference to FIG. 5, the existing wood nailer 204 is attached to a top of the pre-cast concrete wall 202. The base member 10 of the roof edge mounting bracket 1 is secured to the top of the existing wood nailer 204 with a plurality of fasteners 216. The existing insulation 206 is placed over the existing roof 208. At least one layer of additional insulation 218 is placed over the existing insulation 206, the existing nailer 204 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the additional insulation 218 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 6:
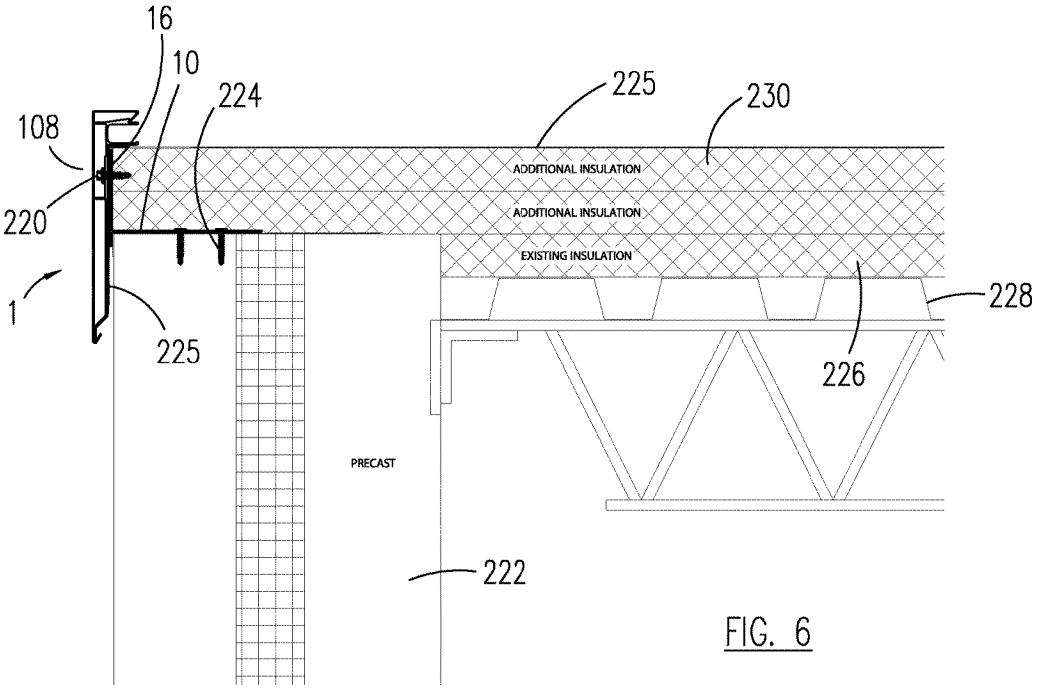
FIG. 6 is a cross sectional view of a building with a pre-cast concrete wall, existing insulation layer and two extended, additional insulation layers with a fascia attached to a top of the pre-cast concrete wall.

With reference to FIG. 6, the base member 10 of the roof edge mounting bracket 1 is secured to a top of a pre-cast concrete wall 222 with a plurality of fasteners 224. Existing insulation 226 is placed over an existing roof 228. At least one layer of additional insulation 230 is placed over the existing insulation 226, the pre-cast concrete wall 222 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the additional insulation 230 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 7:
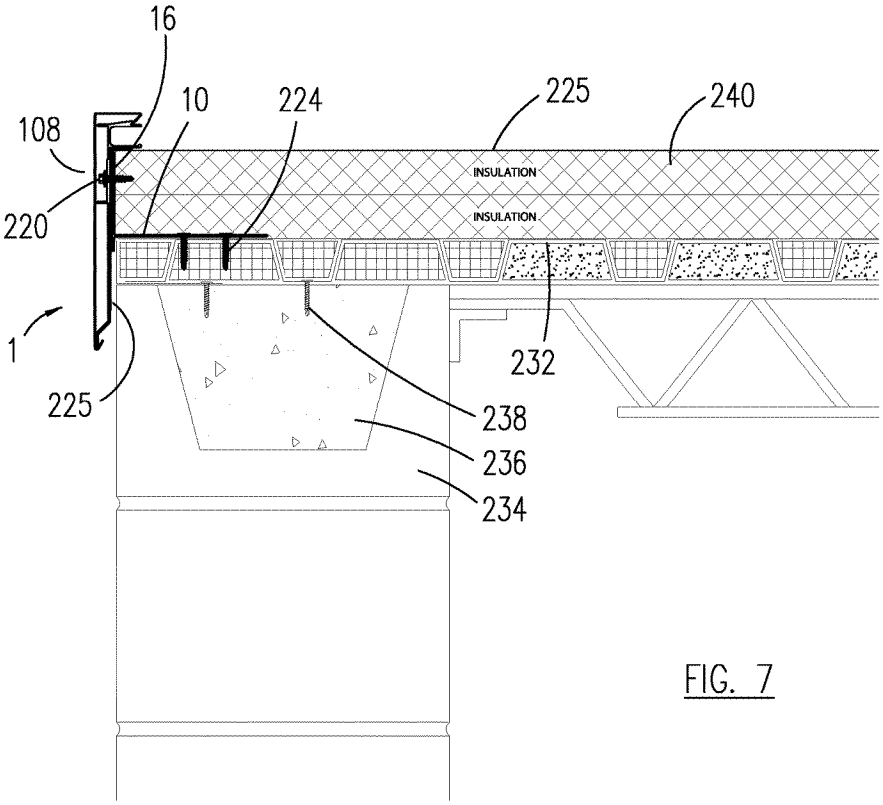
FIG. 7 is a cross sectional view of a building with a concrete block wall, a corrugated metal deck and two insulation layers with a fascia attached to a top of the corrugated metal deck.

With reference to FIG. 7, the base member 10 of the roof edge mounting bracket 1 is secured to a top of a corrugated metal deck 232 with a plurality of fasteners 224. The corrugated metal deck 232 is attached to a concrete insert 236 in a top of a concrete block 234 with a plurality of block fasteners 238. At least one layer of insulation 240 is placed over the corrugated metal deck 232 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the at least one layer of insulation 240 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 8:
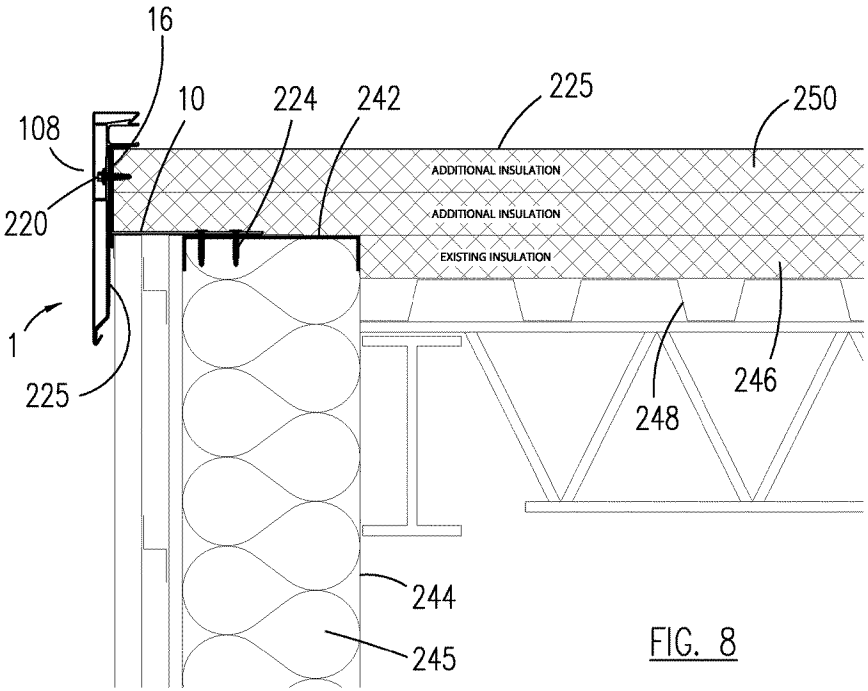
FIG. 8 is a cross sectional view of a building with a plurality of insulation filled metal stud walls, a cap channel, an existing layer of insulation, two additional insulation layers with a fascia attached to a top of the cap channel.

With reference to FIG. 8, the base member 10 of the roof edge mounting bracket 1 is secured to a top of a cap channel 242 with a plurality of fasteners 242, which terminates a top of a plurality of metal studs 244. Stud insulation 245 is placed within the plurality of metal studs 244. Existing insulation 246 is placed over an existing roof 248. At least one layer of additional insulation 250 is placed over the existing insulation 246, the cap channel 242 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the at least one layer of additional insulation 250 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 9:
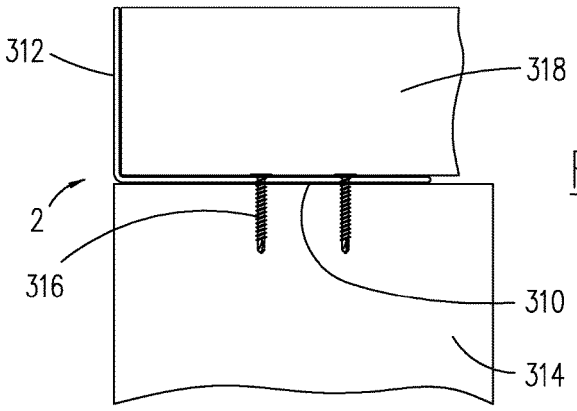
FIG. 9 is a cross sectional view of a roof edge angle bracket attached to a top of a wall in accordance with the present invention.

With reference to FIG. 9, a roof edge angle bracket 2 includes a base member 310 and a vertical attachment flange 312. The vertical attachment flange 312 extends upward from an end of the base member 310. The vertical attachment flange 312 does not include a lower portion. The base member 310 is attached to a top of a wall 314 with a plurality of fasteners 316. At least one layer of insulation 318 contacts an inside surface of the vertical attachment flange 312 and a top of the base member 310.

Figure 10:
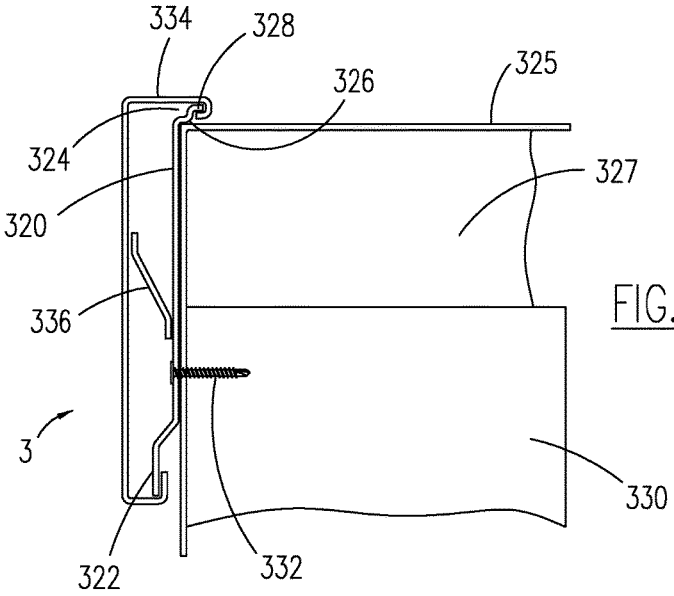
FIG. 10 is a cross sectional view of a vertical roof edge bracket attached to an outer surface of a wall in accordance with the present invention.

With reference to FIG. 10, a roof edge vertical bracket 3 preferably includes a vertical attachment flange 320, a bottom offset lip 322 and an upper retaining lip 324. The bottom offset lip 322 extends from a bottom of the vertical attachment flange 320. The upper retaining lip 324 extends upward from a top of the vertical attachment flange 320. The upper retaining lip 324 includes a turned over lip 326 and a clip extension 328. The clip extension 328 extends from a top of the turned over lip 326. A roof membrane 325 is laid over the at least one layer of insulation 227 and an outside surface of a wall 330. The vertical attachment flange 320 is placed on the roof membrane 325 and attached to the wall 330 with a plurality of fasteners 332. A top and bottom of a fascia cover 334 is retained on the offset lip 322 and the clip extension 328. A spring clip 336 extending from an inside surface of the fascia cover 334 is used to lock the fascia cover on the roof edge vertical bracket 3.

Figures 11, 12:
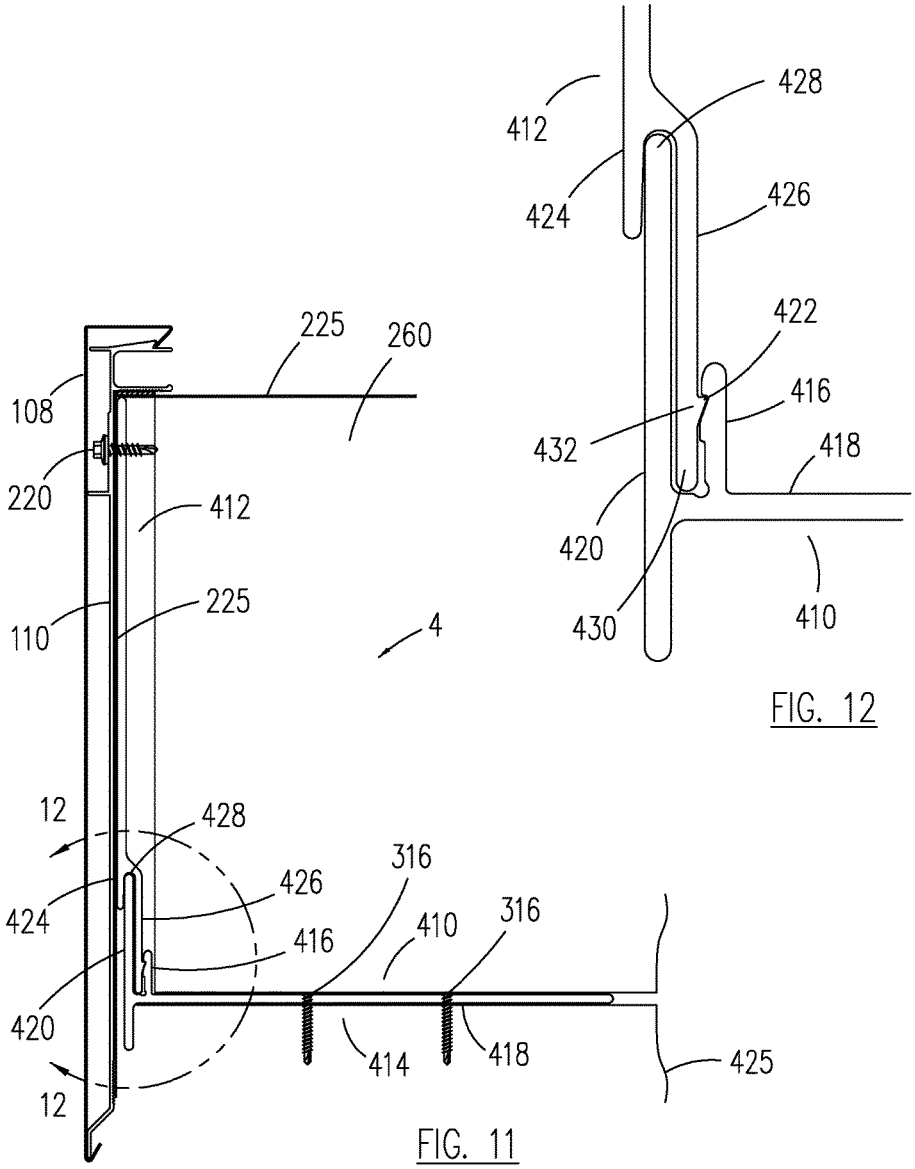
FIG. 11 is an end view of a roof edge bracket extender for providing an extended mounting surface for a fascia in accordance with the present invention.
FIG. 12 is an enlarged end view of a roof edge bracket extender for providing an extended mounting surface for a fascia cut through FIG. 11 in accordance with the present invention.

With reference to FIGS. 11-12, a roof edge bracket extender 4 preferably includes a modified roof edge bracket 410 and an extender plate 412. The modified roof edge bracket 410 includes a roof edge bracket 414 and an extender projection 416. The roof edge bracket 414 includes a base member 418 and a vertical attachment flange 420. The base member 418 of the modified roof edge bracket 410 is secured to a top of a wall 425 with a plurality of fasteners 316. The base member 418 extends inward from the vertical attachment flange 420. The extender projection 416 is formed parallel to the vertical attachment flange 420. The extender projection 416 extends upward from a top of the base member 418. A lengthwise notch 422 is formed on an inner surface of the extender projection 416. The extender plate 412 includes an outer leg 424 and an inner leg 426 extending from a bottom thereof. A flange pocket 428 is formed between the inner and outer legs 424, 426. The flange pocket 428 is sized to receive the vertical attachment flange 420. A leg pocket 430 is formed between the extender projection 416 and the vertical attachment flange 420 to receive the inner leg 426. A snap projection 432 is formed on an outer surface of the inner leg 426. The lengthwise notch 422 is sized to receive the snap projection 432. The vertical attachment flange 420 is inserted into the flange pocket 428 and the inner leg 426 is inserted into leg pocket 430 and retained in place when the snap projection 432 engages the lengthwise notch 422. The roof membrane 225 is preferably laid over a top of the at least one layer of insulation 260 and located between a base portion 110 of the fascia trim 108 and the extender plate 412. The base member 110 is secured to the extender plate 412 with the plurality of trim fasteners 220.

Figure 13:
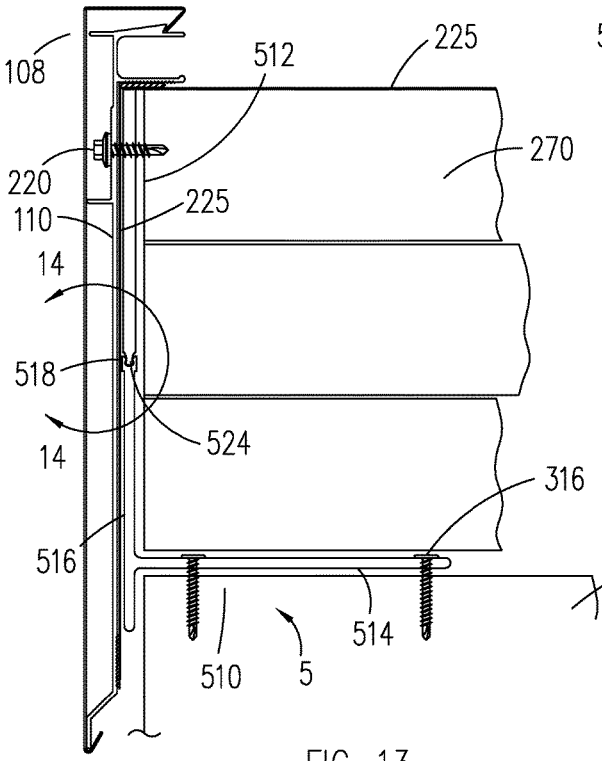
FIG. 13 is an end view of a second embodiment of a roof edge bracket extender for providing an extended mounting surface for a fascia in accordance with the present invention.
Figure 14:
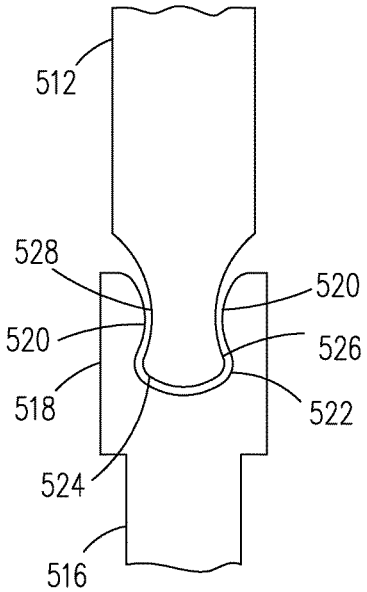
FIG. 14 is an enlarged end view of a second embodiment of a roof edge bracket extender for providing an extended mounting surface for a fascia cut through FIG. 13 in accordance with the present invention.

With reference to FIGS. 13-14, a second embodiment of a roof edge bracket extender 5 preferably includes a second modified roof edge bracket 510 and a second extender plate 512. The modified roof edge bracket 5 includes a base member 514 and a vertical attachment flange 516. The base member 514 of the modified roof edge bracket 5 is secured to a top of the wall 425 with the plurality of fasteners 316. The base member 514 extends inward from the vertical attachment flange 516. An interference slot 518 is formed on a top edge of the vertical attachment flange 516, along a length of the vertical attachment flange 516. The interference slot 518 includes a pair of opposing side walls 520 and a retention cavity 522. The retention cavity 522 is wider than a distance between the side walls 520. The second extender plate 512 includes a lengthwise snap projection 524 formed on a bottom thereof. The lengthwise snap projection 524 includes a snap portion 526 and a relieved portion 528. The relieved portion 528 extends from a bottom of the second extender plate 512. The snap portion 526 extends from a bottom of the relieved portion 528. The snap portion 526 is wider than a distance between the pair of opposing side walls 520. A width of the retention cavity 522 is sized to receive a width of the snap portion 524. The roof membrane 225 is preferably laid over a top of the at least one layer of insulation 270 and located between a base portion 110 of the fascia trim 108 and the second extender plate 512. The base member 110 is secured to the second extender plate 512 with the plurality of trim fasteners 220.

Figure 15:
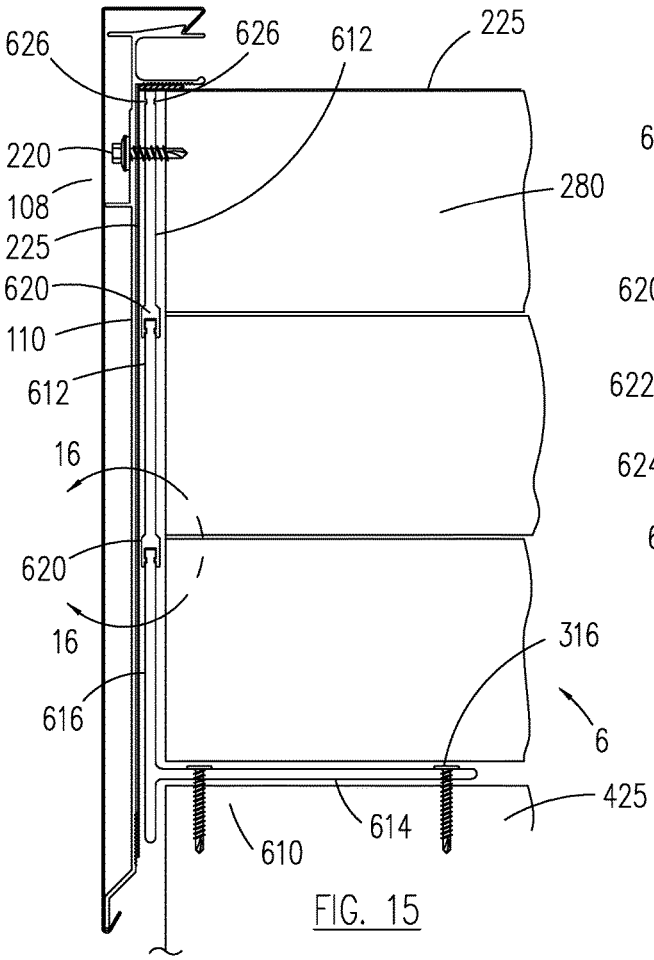
FIG. 15 is an end view of a third embodiment of a roof edge bracket extender for providing an extended mounting surface for a fascia in accordance with the present invention.
Figure 16:
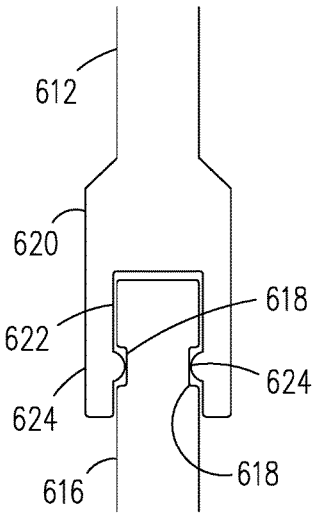
FIG. 16 is an enlarged end view of a third embodiment of a roof edge bracket extender for providing an extended mounting surface for a fascia cut through FIG. 15 in accordance with the present invention.

With reference to FIGS. 15-16, a third embodiment of a roof edge bracket extender 6 preferably includes a third modified roof edge bracket 610 and at least one third extender plate 612. The third modified roof edge bracket 6 includes a base member 614 and a vertical attachment flange 616. The base member 614 extends inward from the vertical attachment flange 616. The base member 614 of the modified roof edge bracket 6 is secured to a top of the wall 425 with the plurality of fasteners 316. A pair of opposing snap slots 618 are formed in a top of the vertical attachment flange 616, along a length of the vertical attachment flange 616. The third extender plate 612 includes an attachment yoke 620 extending from a bottom thereof. The attachment yoke 620 includes a retention slot 622 and a pair of opposing snap projections 624. The retention slot 622 is sized to receive a thickness of the vertical attachment flange 616. The pair of opposing snap projections 624 extend from opposing side walls of the retention slot 622. The opposing snap projections 624 are sized to be received by the pair of opposing snap slots 618 formed in the vertical attachment flange 616. A pair of opposing extender snap slots 626 may be formed in a top of the third extender plate 612 to receive an attachment yoke 620 of an additional extender plate 612. The roof membrane 225 is preferably laid over the top of the at least one layer of insulation 280 and located between a base portion 110 of the fascia trim 108 and the third extender plate 612. The base member 110 is secured to the third extender plate 612 with the plurality of trim fasteners 220.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A roof edge bracket extender for extending insulation over a top of a wall of a building, said roof edge mounting bracket extender is attached to the wall or a nailer, comprising:

a roof edge bracket includes a roof edge mounting bracket and an extender projection, said roof edge mounting bracket includes a base member and a vertical attachment flange, said base member extends from said vertical attachment flange, said extender projection extends upward from a top of said base member, a lengthwise notch is formed on an inner surface of said extender projection; and an extender plate includes an outer leg and an inner leg formed on a bottom of said extender plate, a flange pocket is formed between said inner leg and said outer leg, said flange pocket is sized to receive said vertical attachment flange, a leg pocket is formed between said extender projection and said vertical attachment flange to receive said inner leg, a snap projection is formed on an outer surface of said inner leg, wherein said vertical attachment flange is inserted into said flange pocket, said inner leg is inserted into said leg pocket and retained in place when the snap projection engages said lengthwise notch.

2. The roof edge bracket extender of claim 1 wherein:

said roof edge bracket and said extender plate are fabricated from an aluminum extrusion.

3. The roof edge bracket extender of claim 1 wherein:

said base member is secured to the top of the wall or the nailer with a plurality of fasteners.

* * * * *